US005845696A

United States Patent [19]

Chou

[11] Patent Number: 5,845,696

[45] Date of Patent: Dec. 8, 1998

[54] CHAIN AND CORD SAFETY DEVICE FOR ADJUSTABLE BLINDS

[75] Inventor: Gene Chou, Villa Park, Calif.

[73] Assignee: Rainbow Industrial, Inc., Anaheim, Calif.

[21] Appl. No.: 71,593

[22] Filed: May 1, 1998

[51] Int. Cl.[6] ..... E06B 9/30

[52] U.S. Cl. ..... 160/178.1 V; 160/169.1 V; 160/321

[58] Field of Search ..... 160/178.1 R, 178.1 V, 160/168.1 R, 168.1 V, 176.1 R, 176.1 V, 321, 344, 347, 320; 16/81, 194, 213, 210, 215, 211; 474/136, 84, 165, 140

[56] References Cited

U.S. PATENT DOCUMENTS 4,732,202 3/1988 Anderson .
4,896,713 1/1990 Rademacher ..... 160/321 X
5,125,447 6/1992 Suggs .
5,577,543 11/1996 Jelic ..... 160/178.1 R
5,752,558 5/1998 Lin .

FOREIGN PATENT DOCUMENTS 3428483 6/1985 Germany ..... 160/321

*Primary Examiner*—Blair M. Johnson
*Attorney, Agent, or Firm*—Robert R. Thornton

[57] ABSTRACT

A blind cord safety device for use in controlling an adjustable blind having a looped control cord and a looped control chain by enclosing the loops has housing within which are disposed a rotatable wheel adapted to engage the chain loop thereabout and a U-shaped cord loop receiver adapted to receive the cord loop in a peripheral groove formed thereon. The receiver is mounted within the housing so as to permit limited longitudinal but not lateral movement of the receiver within the housing. A spring is disposed within the housing between the receiver and the housing top so as to normally urge the receiver away from the housing top so as to avoid slack in the cord as a result of the cord stretching over time as a result of use.

12 Claims, 4 Drawing Sheets

CHAIN AND CORD SAFETY DEVICE FOR ADJUSTABLE BLINDS

BACKGROUND OF THE INVENTION

This invention relates to a chain and cord safety device for use with horizontal or vertical panel blinds, whereby the hanging looped ends of the blind control chain and blind control cord used to open or close the blind panels and to open or close the blind itself are enclosed as a safety measure.

In conventional horizontal or vertical blinds, two control cords and/or chains are used to control the operation of the blind. The cords or chains hang down from the housing for the blind, which extends transversely across or in a window or doorway opening. One cord or chain is used to control the rotational movement of the blind panels relative to the opening to open or close the blind. The other is used to physically displace the panels either horizontally or vertically with respect to the opening, to selectively place the blind panels in their operating position with respect to the opening, or to remove the blind panels from the opening. The cords or chains hang down from the housing in the form of loops, a selected side of which is manually pulled to produce the function associated with that cord or chain. Preferably, both loops are formed at the same side of the housing, for ease of operation.

It has been found that the use of unprotected loops presents a safety hazard to small children, as the loops conventionally are located near the floor. The loop may be placed about the child's neck, resulting in choking, or, in extreme cases, strangulation, or the loop may be placed in the child's mouth, which, in addition to the obvious lack of sanitation, may also result in choking if attempted to be swallowed. Consequently, there is a need for devices which provide for ease of use of the blind controls while avoiding the danger presented by the use of unprotected cord and chain loops. In addition, while a chain normally does not stretch in use over time, even when under tension, a cord will stretch over time, thus becoming loose after a period of use in many of the prior art control devices which use combined chain and cord control systems.

BRIEF SUMMARY OF THE INVENTION

According to the present invention, a chain and cord safety device for use in controlling an adjustable blind having a looped control cord and a looped control chain utilizes a housing which is generally rectangular in lateral cross-section with sides and a bottom which are normally closed and a top, within which a wheel adapted to engage the chain loop is rotatably disposed and within which a cord loop receiver having a semi-circular lower portion adapted to receive the cord loop is mounted so as to permit limited longitudinal but not lateral movement of the receiver within the housing so as to normally be urged away from the housing top, the top providing for access to the interior of the housing so as to permit the chain loop to engage the wheel and the cord loop to engage the lower portion of the cord receiver.

BRIEF DESCRIPTION OF THE DRAWING

The invention may be more readily understood by reference to the accompanying drawing, in which.

DETAILED DESCRIPTION OF THE PREFERRED EMBODIMENTS

Figure 1:
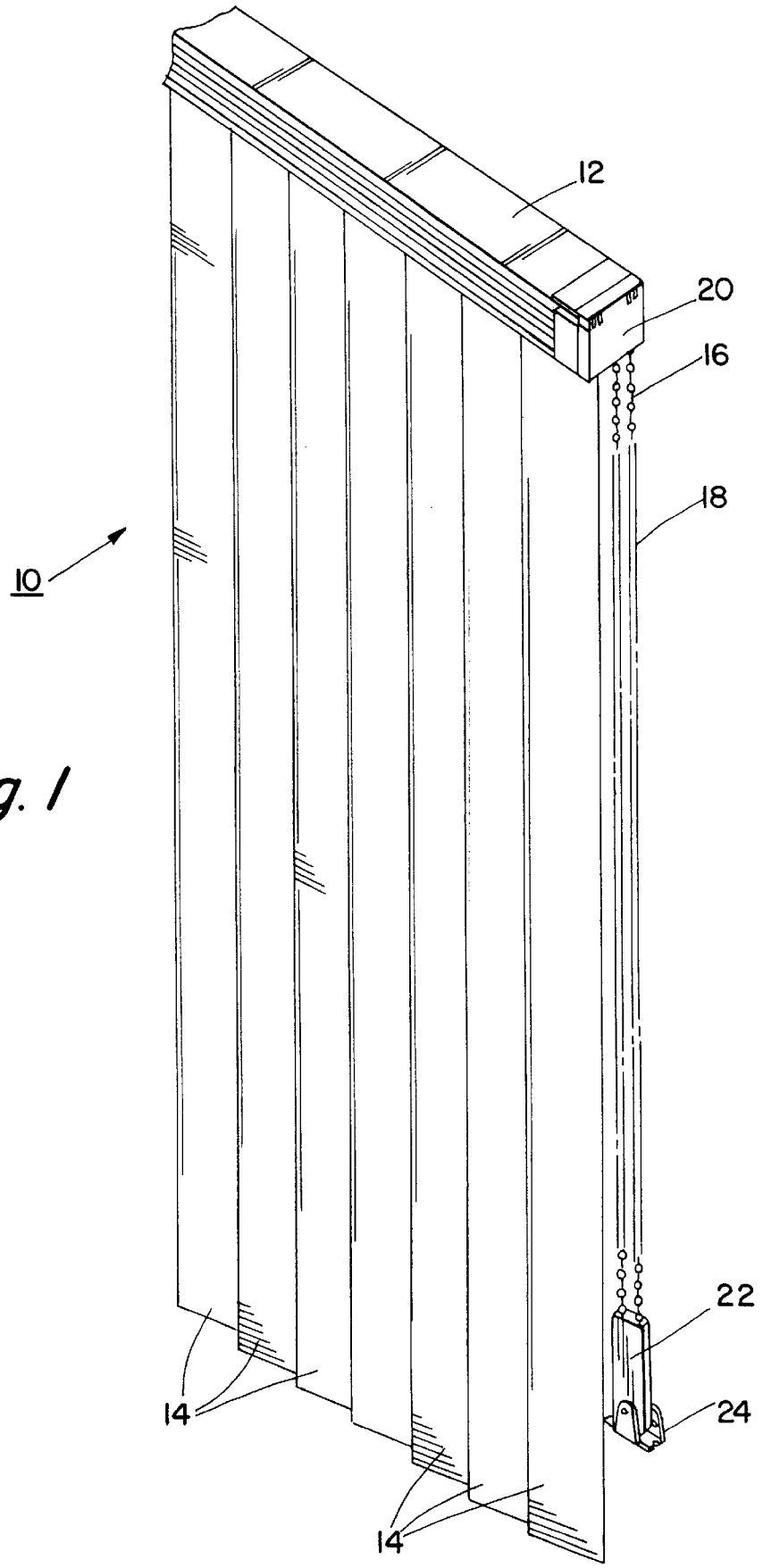
FIG. 1 is a partial view, in perspective, of a the chain and cord safety device of the present invention installed for use with a vertical blind, the utilization of a vertical blind being for purposes of illustration only, as the present invention is equally applicable to horizontal blinds.

Referring now to FIG. 1, there is shown a partial view of a vertical blind 10, which has a slide track casing 12, from which a plurality of vertical panels 14 depend in conventional fashion. A looped chain 16 and a looped cord 18 depend from one end 20 of the casing 12 in conventional fashion. The chain 16 is utilized to control the longitudinal rotational adjustment of the panels and the cord 18 is utilized to draw the panels laterally toward or extend the panels laterally out from the end 20 in conventional fashion.

A cord and chain safety device housing 22 according to the present invention encloses the looped ends (not shown) of the chain 16 and cord 18. In the preferred embodiment, the housing 22 is attached to a wall or other building structural member (not shown) by an attaching member 24 so as to maintain a greater tension on the cord 18 than would otherwise occur if the weight of the housing 22 is solely relied upon for providing the tension, as will be explained hereinafter.

Figure 2:
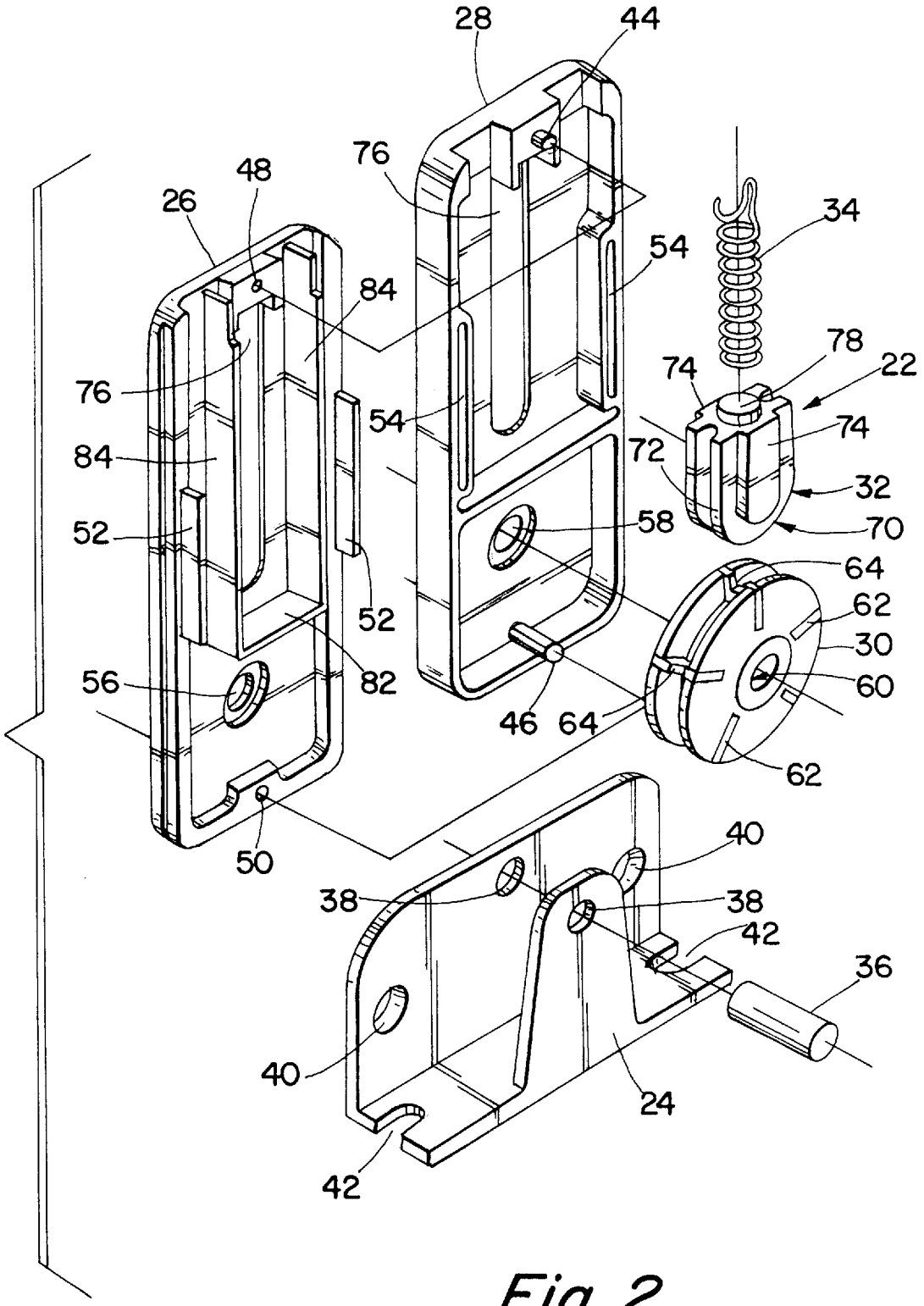
FIG. 2 is a view, in perspective, of the chain and cord safety device of FIG. 1 shown in its disassembled form.
Figure 3:
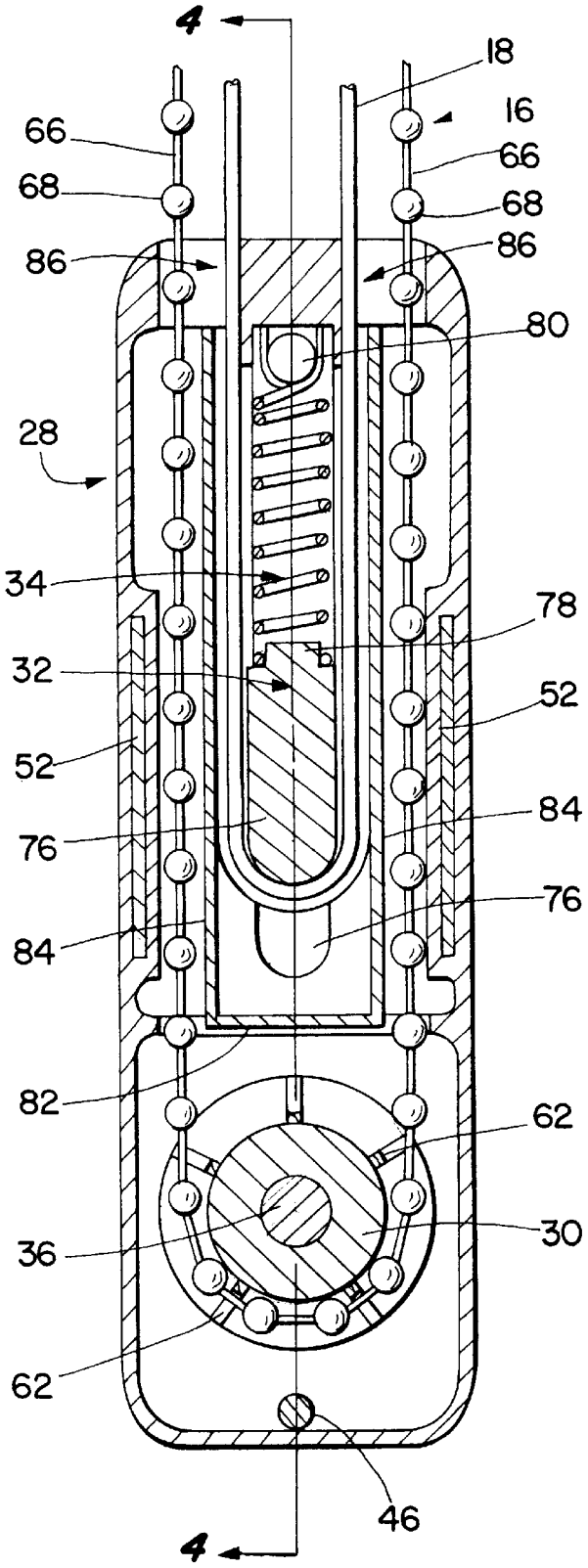
FIG. 3 is a front elevation, in section, of the chain and cord safety device of FIG. 2.
Figure 4:
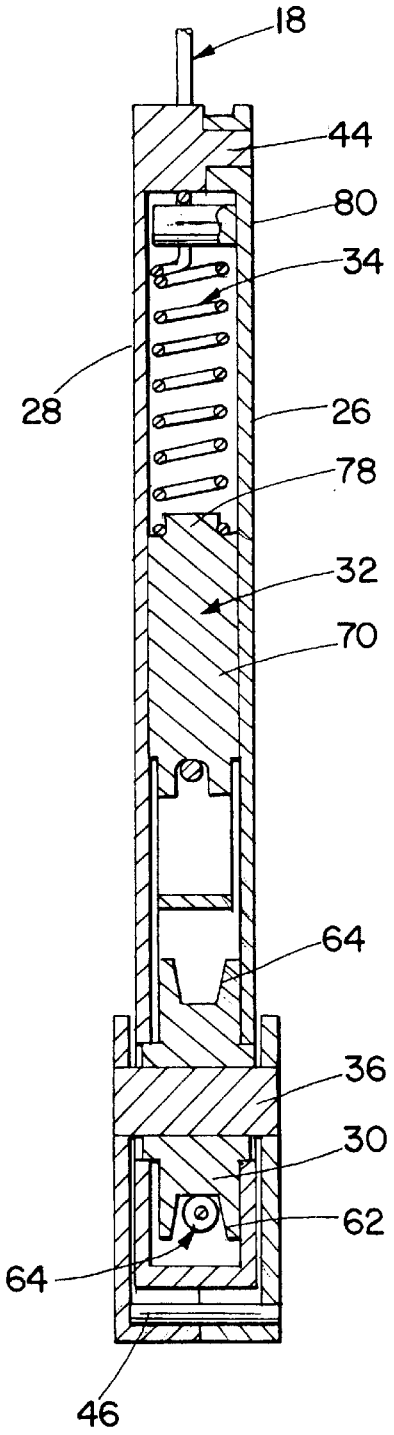
FIG.4 is a view, in section, of the chain and cord safety device of FIG. 2, taken along line 4—4 of FIG. 3.

Referring now to FIGS. 2, 3 and 4, the housing 22 illustrated in FIG. 1 is shown in its disassembled form. As seen in FIG. 2, the housing 22 includes a first housing element 26, a second housing element 28, a chain engaging wheel 30, and a cord engaging receiver 32, together with a spring 34 and a mounting pin 36. The attaching plate 24 has a pair of vertical walls 24A, 24B, connected together by a horizontal base plate 24C. The vertical walls 24A, 24B each have a pin receiving aperture 38, axially aligned with one another through which the pin 36 extends so as to provide a rotatable mounting for the wheel 30, as is best shown in FIGS. 3 and 4. The attaching plate wall 24A also has a pair of mounting apertures 40 formed therein to permit the attachment of the attaching member 24 to a wall by conventional fasteners, and the horizontal base plate 24C has a pair of mounting slots 42 formed therein to facilitate the attachment of the attaching member 24 to a floor or sill, if desired rather than the wall attachment.

The first housing member 26 and the second housing member 28 have various complementary structural features to assist in the alignment of the two housing members, when assembled, to provide the unitary housing 22 illustrated in FIG. 1. Thus, the second housing element 28 has an upper pin 44 and a lower pin 46 which fit into complementary recesses 48, 50 formed in the first housing element 26. In addition, the first housing element 26 has a pair of blades 52 which fit into complementary slots 54 formed in the second housing element 28.

The first housing element 26 has a pin receiving aperture 56 centrally disposed in the lower portion thereof, and the second housing member 28 has a similar aperture 58 formed therein so as to be axially aligned with the first housing element aperture 56 when the two housing elements 26, 28 are assembled together by the engagement of the complementary elements 44 and 48, 46 and 50, 52, and 54. In this disposition the pin 26 extends through an axially disposed mounting aperture 60 in the wheel 30, so that the wheel 30 is rotatably mounted within the housing 22.

The wheel 30 has a plurality of chain engaging spokes 62 extending radially outwardly from adjacent the aperture 60. Each of the spokes has a notch 64 formed therein so as to accept links 66 which connect together balls 68 forming the chain 16, while holding the balls 68 between adjacent spokes 62, so that the wheel 30 rotates as the chain 16 is pulled to adjust the panels 14.

The cord engaging receiver 32 is U-shaped with a generally semi-circular lower portion 70, with a peripheral cord receiving groove 72 formed therein so as to extend upwardly away from the lower portion 70. A pair of shoulders 74 are formed on the receiver 32 so as to extend outwardly transversely of the groove 72. The shoulders 74 engage a pair of complementary recesses 76 formed in the first and second housing members 28, 28, so as to permit longitudinal movement of the receiver 32 in the housing 22, while preventing lateral movement of the receiver 32 there within.

The receiver has a boss 78 formed on its upper surface. The boss engages the spring 34 at one end thereof. A stop pin 80 is formed on the interior of the second housing element 28 (see FIG. 3) so as to engage the other end of the spring 34 to hold the spring 34 within the housing 22 and urge the receiver 32 downwardly away from the top of the housing 22. A stop plate 82 formed on the first housing element 26 so as to be located between the wheel 30 and the receiver 32 limits the downward motion of the receiver 32 under the influence of the spring 34. Extending upwardly from each end of the stop plate 82 is a separator plate 84, which serves to separate the loop of the chain 16 within the housing 22 from contact with the loop of the cord 18 within the housing, as is best shown in FIG. 3. The top of the second housing element 28 has openings 86 on both sides the upper pin 44 to provide for ingress and egress of the chain 16 and cord 18. The first housing element 26 has complementary openings (not shown in FIG. 3).

In use, the housing 22 is opened as shown in FIG. 2 by the removal of the pin 36. The chain 16 and cord 18 are installed about the wheel 30 and receiver 32, respectively, as shown in FIG. 3 after the respective lengths of the chain and cord loops have been adjusted to provide for the desired tension on the cord 18. The device is then reassembled by the insertion of the pin through the housing elements 26, 28 and the wheel 30. The housing 22 is then attached to the attaching plate 24 by the pin 36 and the entire assembly fixed to the desired surface by use of the attaching plate 24 and appropriate fasteners (not shown). Failure to use the attaching plate 24 may result in insufficient tension being applied to the cord 18 by the receiver 32 and spring 34 after a period of use because the cord was not initially under maximum tension, thereby degrading the performance of the device of the present invention.

In FIGS. 2, 3, and 4, the housing 22 is configured so that the wheel 30 and receiver 32 are disposed one over the other in vertical alignment, with the receiver 32 on top. While this is the presently preferred configuration of this embodiment of the invention, it is, of course, within the scope of the invention to reverse these relative dispositions, so that the wheel 30 is above the receiver 32, by an appropriate change in the relative dimensions thereof.

Figure 5:
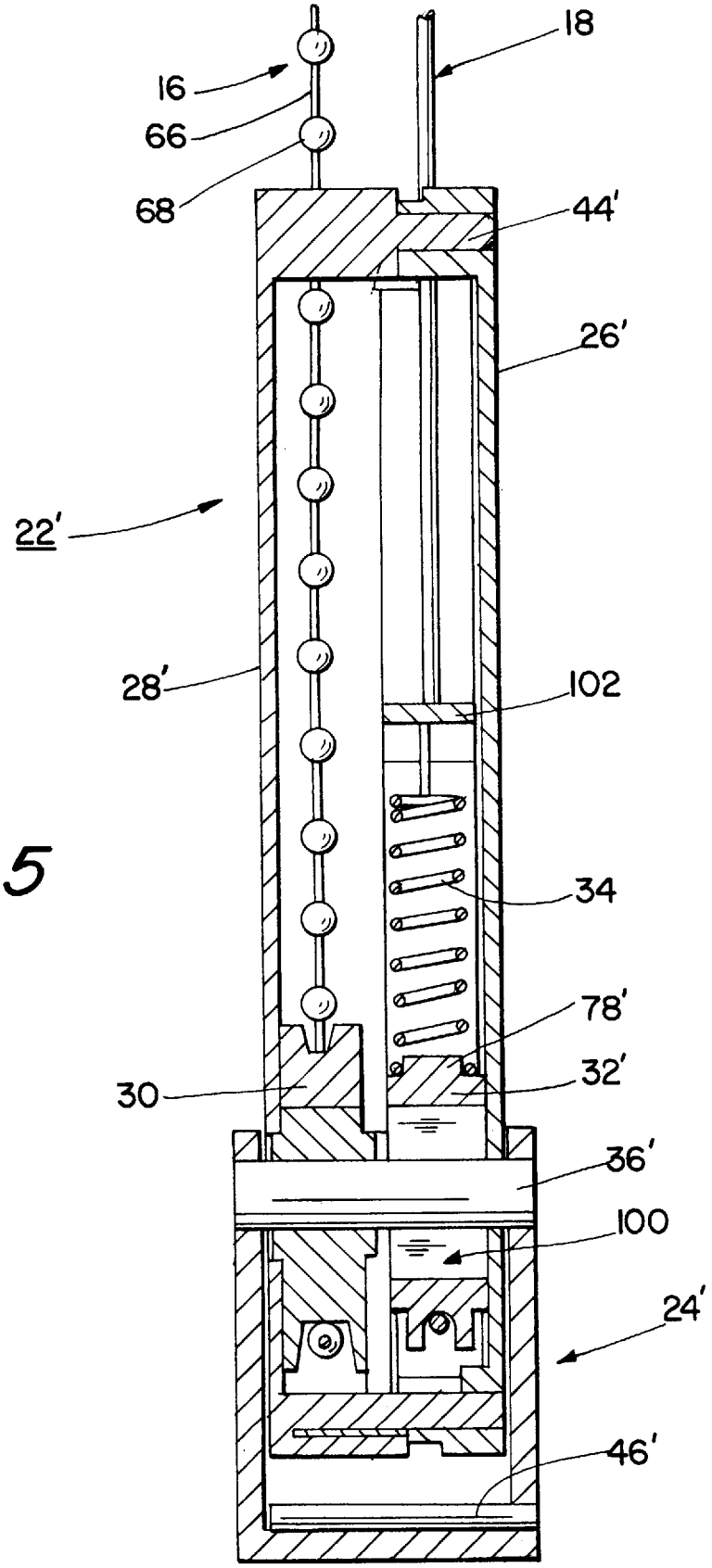
FIG. 5 is a view, in section similar to that of FIG. 4, of an alternate embodiment of a chain and cord safety device according to the present invention.

FIG. 5 illustrates, in cross section, an alternate embodiment of the invention, in which the wheel and receiver are in horizontal alignment, rather than in vertical alignment. In the embodiment of FIG. 5, a housing 22' has a first housing element 26' and a second housing element 28'. An attaching plate 24' has a pin 36' extending therethrough so as to attach the housing 22' to the attaching plate. The pin 36' passes through the wheel 30, which may be identical to the wheel 30 of FIG. 2. A receiver 32' differs from the receiver 32 of FIG. 2 in that there is a longitudinal slot 100 formed in the body of the receiver 32' so as to permit the pin 26' to pass through the receiver, thereby permitting the receiver 32' to move longitudinally with respect to the housing in order to apply the appropriate tension to the cord 18. A stop plate 102 extends inwardly from the interior face of the first housing element 26' so as to retain the spring 34 in place against the receiver 32' at a boss 78'. The remaining details of the structure and operation of the alternate embodiment of FIG. 5 will be apparent from the foregoing description of the structure and operation of the embodiment of FIGS. 2, 3, and 4.

The present invention has been described as to the details of its presently preferred embodiments. It will be obvious to those skilled in the art that various changes can be made in the specific structures disclosed herein, which do not depart from the scope of the invention as defined in the claims hereof and the equivalents of the various claim elements.

The invention claimed is:

1. A blind cord safety device for use in controlling an adjustable blind having a looped control cord and a looped control chain comprising:

an elongate housing with a hollow interior, said housing being generally rectangular in lateral cross-section with sides and a bottom which are normally closed and a top;

a wheel adapted to engage the chain loop;

first mounting means connected to said housing for rotatably mounting said wheel within the hollow interior of said housing;

a cord loop receiver having a semi-circular lower portion adapted to receive the cord loop thereabout, said receiver being nonrotatable;

second mounting means connected to said housing for mounting said receiver within the hollow interior of the housing so as to permit limited longitudinal but not lateral movement of the receiver within the housing;

bias means disposed within the housing between the receiver and the housing top so as to normally urge the receiver away from the top;

means formed in the top of the housing for providing access for the chain and the cord to the interior of the housing so as to permit the chain loop to engage the wheel and the cord loop to engage the lower portion of the cord receiver; and means selectively operable to open and close the housing so as to permit the installation and removal of the chain loop about the wheel and the cord loop about the receiver.

2. The device of claim 1, and including means selectively operable to permit the opening and closing of the housing for the selective installation and removal of the chain loop and the cord loop.

3. The device of claim 2, and in which the first mounting means includes a pin which is selectively removable to permit the opening and closing of the housing.

4. The device of claim 1, and including attaching plate means for attaching the device to a supporting surface.

5. The device of claim 2, and including attaching plate means for attaching the device to a supporting surface.

6. The device of claim 3, and including attaching plate for attaching the device to a supporting surface, said attaching plate being selectively connected to the housing by the pin, said pin extending transversely through and beyond said housing so as to be in selective engagement with said attaching plate.

7. The device of claim 1, and in which the bias means includes a spring in engagement with the receiver and a stop formed within the housing.

8. The device of claim 2, and in which the bias means includes a spring in engagement with the receiver and a stop formed within the housing.

9. The device of claim 3, and in which the bias means includes a spring in engagement with the receiver and a stop formed within the housing.

10. The device of claim 4, and in which the bias means includes a spring in engagement with the receiver and a stop formed within the housing.

11. The device of claim 5, and in which the bias means includes a spring in engagement with the receiver and a stop formed within the housing.

12. The device of claim 6, and in which the bias means includes a spring in engagement with the receiver and a stop formed within the housing.

* * * * *